US007312564B2

(12) United States Patent
Gueugnon et al.

(10) Patent No.: US 7,312,564 B2
(45) Date of Patent: Dec. 25, 2007

(54) CATHODE RAY TUBE HAVING AN ELECTRON GUN

(75) Inventors: Nicolas Gueugnon, Dijon (FR); Pierre Bizot, Marsannay la Cote (FR); Grégoire Gissot, Plombière les Dijon (FR); Nicolas Richard, Dijon (FR)

(73) Assignee: Thomson Licensing, Boulogne (FR)

( * ) Notice: Subject to any disclaimer, the term of this patent is extended or adjusted under 35 U.S.C. 154(b) by 200 days.

(21) Appl. No.: 10/938,671

(22) Filed: Sep. 10, 2004

(65) Prior Publication Data

US 2005/0052110 A1 Mar. 10, 2005

(30) Foreign Application Priority Data

Sep. 10, 2003 (FR) ..... 03 50521

(51) Int. Cl.
*H01J 29/51* (2006.01)
*H01J 29/62* (2006.01)

(52) U.S. Cl. ..... 313/409; 313/414; 313/441; 313/446; 313/447; 315/15; 315/382

(58) Field of Classification Search ..... 313/409, 313/412, 414, 446, 426, 427, 441, 447; 315/364
See application file for complete search history.

(56) References Cited

U.S. PATENT DOCUMENTS

| | | | | |
|---|---|---|---|---|
| 4,608,515 A | | 8/1986 | Chen | 313/412 |
| 4,890,032 A | | 12/1989 | Bijma et al. | 313/412 |
| 5,015,910 A | * | 5/1991 | Takahashi et al. | 313/414 |
| 5,027,043 A | | 6/1991 | Chen et al. | 315/368 |
| 5,055,749 A | * | 10/1991 | Chen et al. | 315/368.11 |
| 5,517,078 A | | 5/1996 | Sugawara et al. | 313/412 |
| 5,539,285 A | * | 7/1996 | Iguchi et al. | 315/382 |
| 5,631,521 A | | 5/1997 | Hasegawa et al. | 313/414 |
| 5,798,603 A | * | 8/1998 | Tsuruoka et al. | 313/412 |
| 5,907,217 A | | 5/1999 | Gorski et al. | 315/15 |

(Continued)

FOREIGN PATENT DOCUMENTS

EP 0 739 028 A2 10/1996

(Continued)

OTHER PUBLICATIONS

Search Report.

*Primary Examiner*—Sikha Roy
(74) *Attorney, Agent, or Firm*—Joseph J. Laks; Harvey D. Fried; Richard LaPeruta

(57) ABSTRACT

A cathode ray tube has an electron gun oriented along an axis (Z), comprising a quadrupolar device which comprises three electrodes (5, 6, 7). Each electrode possesses a central aperture, a right lateral aperture and a left lateral aperture all three substantially rectangular. The centers (c5.1, c7.1) of the central apertures of the three electrodes are aligned along the axis (Z) of the gun. The centers (c6.1, c6.3) of the left and right lateral apertures of the second electrode (6) are situated along respectively a first axis (z1) and a second axis (z3) that are parallel to the axis (Z) of the gun. The centers (c5.1, c7.1) of the left and right lateral apertures (5.1, 5.3, 7.1, 7.3) of the first and/or of the third electrode (5,7) are offset with respect to the axes (z1, z3) passing through the centers of the apertures of the second electrode. Such an arrangement makes it possible to correct the MODEC defects.

5 Claims, 6 Drawing Sheets

U.S. PATENT DOCUMENTS

| | | | | |
|---|---|---|---|---|
| 6,335,597 | B1 * | 1/2002 | Ueno et al. | 315/364 |
| 6,400,105 | B2 * | 6/2002 | Uchida et al. | 315/382 |
| 6,693,398 | B2 * | 2/2004 | Cho | 315/368.11 |
| 6,815,881 | B2 * | 11/2004 | Chen et al. | 313/414 |

FOREIGN PATENT DOCUMENTS

| | | |
|---|---|---|
| EP | 0 913 851 A2 | 5/1999 |

* cited by examiner

CATHODE RAY TUBE HAVING AN ELECTRON GUN

FIELD OF THE INVENTION

The invention relates to a cathode ray tube having an electron gun suitable for high definition.

BACKGROUND OF THE INVENTION

A conventional television tube comprises an almost plane faceplate or screen of rectangular shape. The screen is furnished on its internal face with a mosaic of patches of phosphors or pixels which excited by an electron beam emit light which may be blue, green or red, depending on the phosphor excited.

An electron gun sealed in the envelope of the tube is directed towards the centre of the screen and makes it possible to emit the electron beam towards the various points of the screen through a perforated mask (or shadow mask). The electron gun makes it possible to focus the electron beam onto the internal face of the screen carrying the phosphors.

A deviating system placed around or on either side of the tube makes it possible to act on the direction of the electron beam so as to deviate its trajectory. Continual action of the deviating system thus allows horizontal and vertical scanning of the screen so as to explore the entire mosaic of phosphors.

Without deviation of the electron beam and with symmetric electrodes of the gun that create symmetric electric fields in the gun, the electron beam reaches the centre of the screen.

When the deviating system is acted on and the direction of the beam is deflected, the spot on the screen is deformed and the problem is all the more crucial as the beam is deflected towards the periphery of the screen or even towards the corners of the screen. In particular, in the case of a rectangular screen whose large dimension is horizontal, a horizontal deflection towards the left and right edges gives rise to a horizontally deformed spot. In the corners there is a vertically and horizontally combined deformation.

To remedy these defects, the art makes provision for electrodes made in the form of quadrupoles and controlled electrically in different ways in the vertical direction and in the horizontal direction, doing so in order to precompensate for the deformations of the beam just described.

The quadrupolar effects thus make it possible to achieve shape factors for the electron beams. These effects tend to counter the phenomena of distortion of shapes of beams created by the deviator in a situation of deviation towards the periphery of the screen and hence of deformation of size of spot on the screen. The shape factor must be dynamic as a function of the deviation of the beam.

The horizontal distortion of the electron beam towards the periphery of the screen is therefore the result of a magnetic deflection caused by the deviator deflecting the beam so as to effect the scanning of the screen, and associated with this deviator the action of an exit quadrupole in the gun. The combining of these effects results in a degradation of the horizontal resolution and a large improvement in the vertical resolution.

A quadrupole structure can comprise three electrodes composed of rectangular holes which make it possible to create the quadrupolar effect and also of circular holes which ensure the proper alignment of the various elements of the electron gun.

In electron guns intended to excite aligned colour pixels on the television screen, each electrode includes three holes allowing the processing and the transmission of three electron beams called the red, green and blue electron beams and intended to excite respectively the pixels of red, green and blue phosphors of the screen.

Moreover, so-called "high definition" guns can also comprise a second quadrupole whose effect is achieved via interdigitated elements called "interdigits" in the subsequent description. This quadrupole makes it possible to tailor the vertical size of the spots at the image edge. These "interdigits" are also used to correct defects related to the gun such as "MODEC" (deriving from the expression "beam deconvergence modulation") by creating a dissymetry at the level of the structure of the holes. On the other hand this dissymetry becomes too great when working on "high-definition" guns.

To finalize the design of an electron gun, it is necessary to tailor the following parameters:

the difference between the place of impact on the screen of the beams outside the voltages V6 and Vf of nominal operation and the place of impact of the beams outside the voltages V6 and Vf of nominal operation at ±1000 volts commonly referred to as FRAT (deriving from the expression "focusing refraction alignment test"). It should be noted that nominal operation is the voltage pair V6 and Vf that makes it possible to focus the electron beams correctly at the centre of the screen.

The MODEC (deriving from the expression "modulation deconvergence") which is the difference between the place of impact of the beams outside the voltages V6 and Vf of (nominal) operation and the place of impact of the beams outside the voltage V6+1000 volts and the nominal voltage Vf. It should be noted that V6 may be equal to Vf plus the modulation applied in a situation of deflection of the electron beams (V6=Vd+Vf).

The FODEC (deriving from the expression "focusing deconvergence") which is the difference between the place of impact of the beams outside the voltages V6 and Vf of (nominal) operation and the place of impact of the beams outside the nominal voltage V6 and the voltage Vf+1000 volts.

As a general rule, the FRAT is corrected by design parameters for the BFR (deriving from the expression "beam formation region") part of the electron gun.

For its part, the MODEC is corrected by a design parameter which occurs at the level of the "interdigits". The "interdigits" form a quadrupolar structure making it possible to improve the vertical size on the edge of the screen. The "interdigits" (FIGS. 5 and 6) consist of two plates opposite one another spaced apart by a distance D.id (FIG. 6*a*) and each drilled with three holes such as 14, 15 and 16 corresponding to the three beams red, green and blue. Each of its holes is composed of two quasi quarters of a cylinder, such as A and B, that are symmetric in the X or Y axis. The quasi quarters of cylinders on the opposite holes are rotated by 90° in the Z axis so as to create the quadrupolar effect. On the outside holes, it is necessary to create a differential Diff (FIG. 6*b*) between these quarters of cylinders so as to ensure a zero MODEC.

As regards certain guns and more particularly guns designed for "high definition" televisions, the differential diff of the two quarters of cylinder of the outside holes is too big and could create a strong dissymmetry at the level of the shape of the beam.

The invention makes it possible to correct the MODEC without needing to dissymmetrize the heights of the opposite quarters of cylinders of the outside holes of the electrodes.

Its advantage is to recentre the beam without however disturbing the latter and it also makes it possible to preserve the conventional alignment of the various elements of the electron gun.

SUMMARY OF INVENTION

The invention therefore relates to a cathode ray tube (CRT) having electron gun, the CRT including an axis of the gun. The gun comprising at least one first quadrupolar device which comprises a first electrode, a second electrode and a third electrode that are disposed in parallel and in series along the axis of the gun. Each electrode possesses a central aperture, a right lateral aperture and a left lateral aperture all three substantially rectangular. The large sides of the apertures of the first and of the third electrode are oriented along a first direction while the large sides of the apertures of the second electrode are oriented along a second direction orthogonal to the first direction. Each aperture possesses a centre. The centres of the central apertures of the three electrodes are aligned along the axis of the gun. The centres of the left and right lateral apertures of the second electrode are situated along respectively a first axis and a second axis that are parallel to the axis of the gun. The centres of the left lateral apertures of the first and/or of the third electrode are situated on a third axis parallel to the axis of the gun and distinct from the first axis. The centres of the right lateral apertures of the first and/or of the third electrode are situated on a fourth axis parallel to the axis of the gun and distinct from the second axis.

BRIEF DESCRIPTION OF THE DRAWINGS

The various aspects and characteristics of the invention will become more clearly apparent in the description which follows and in the appended figures which represent.

DETAILED DESCRIPTION OF THE PREFERRED EMBODIMENTS

According to one embodiment of the invention for the cathode ray tube, the centre of the left aperture of the first electrode is situated on the third axis and the centre of the left aperture of the third electrode is situated on a fifth axis parallel to the axis of the gun and distinct or otherwise from the first axis. The centre of the right aperture of the first electrode is then situated on the fourth axis and the centre of the right aperture of the third electrode is situated on a sixth axis parallel to the axis of the gun and distinct or otherwise from the second axis.

Preferably, the first, the second and the third electrode are of plane form.

According to one embodiment of the invention, the first, third and fifth axes are symmetric respectively with the second, fourth and sixth axes with respect to the axis of the gun.

Moreover, the first and second axes may be symmetric respectively with the third and fourth axes with respect to the axis of the gun.

Moreover, the apertures possess holes allowing the alignment of the electrodes. The holes for aligning the left lateral apertures of the three electrodes are situated along the first axis. Likewise, the holes for aligning the right lateral apertures of the three electrodes are situated along the second axis.

Preferably, the first electrode and the third electrode are set to a fixed polarization potential. The second electrode is set to a polarization potential varying in synchronism with the screen scan.

According to one advantageous embodiment, the electron gun of the invention comprises in succession, aligned in series along its axis:

- an electron-emitting cathode,
- a system of electrodes effecting the formation of an electron beam and its focusing to a so-called crossover point,
- an electron lens for prefocusing the electron beam,
- the first quadrupolar device,
- a second quadrupolar device electrically controlled in a dynamic manner in synchronism with the screen scan so as to correct beam focusing defects at the screen edge,
- a main electron lens making it possible to focus the electron beam onto a screen.

Advantageously, the screen is of rectangular shape and has its large sides oriented parallel to the first direction of orientation of the large sides of the apertures of the electrodes of the first and of the third electrode of the first quadrupolar device.

Likewise advantageously, the first and the third electrode of the first quadrupolar device are at one potential and the same distance d from the second electrode of the same device.

Preferably, the large sides of the apertures of the electrodes possess recesses of circular shapes whose radius R is equal to:

$$R=(H/2)/\cos(\alpha.\Pi/2)$$

with:

H: distance between the two large sides of an aperture $\alpha$: percentage of the perimeter of the circle of radius R.

Figure 1:
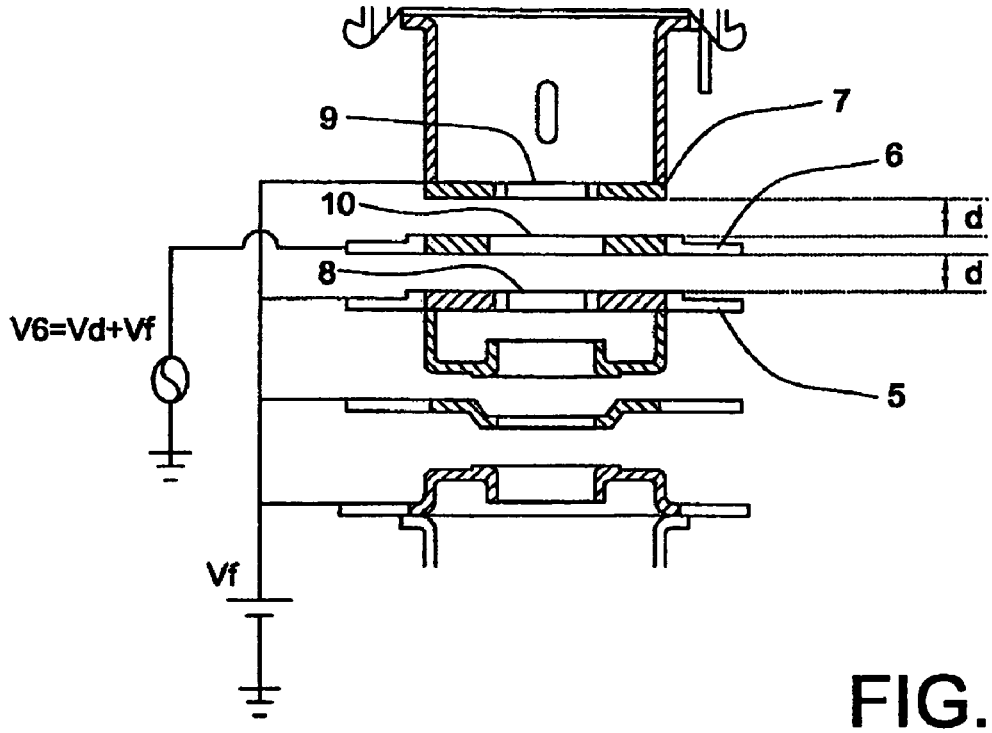
FIG. 1, an exemplary embodiment of a quadrupolar device for electron gun for cathode ray tubes according to the invention applicable to high-definition guns, FIG. 2, a perspective view of the quadrupolar device of FIG. 1, FIG. 3, a plan view of the electrodes of the device of FIG. 2, FIG. 4, a detailed view of the electrodes of the quadrupolar device according to the invention, FIGS. 5, 6*a* and 6*b*, devices known in the art and described previously, FIG. 7, an exemplary aperture of an electrode, FIG. 8, an exemplary electron gun implementing the invention, FIGS. 9*a* and 9*b*, variant embodiments of the invention.

Referring to FIG. 1, an exemplary embodiment of a quadrupolar device according to the invention for high-definition electron gun for cathode ray tube and in particular for television tube will therefore be described.

A quadrupolar device includes three electrodes 5, 6 and 7.

Figure 2:
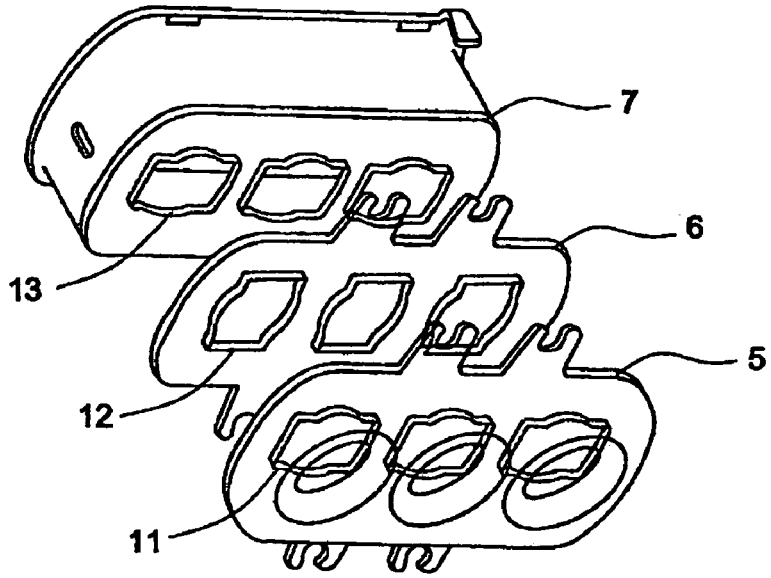
Figure 3:
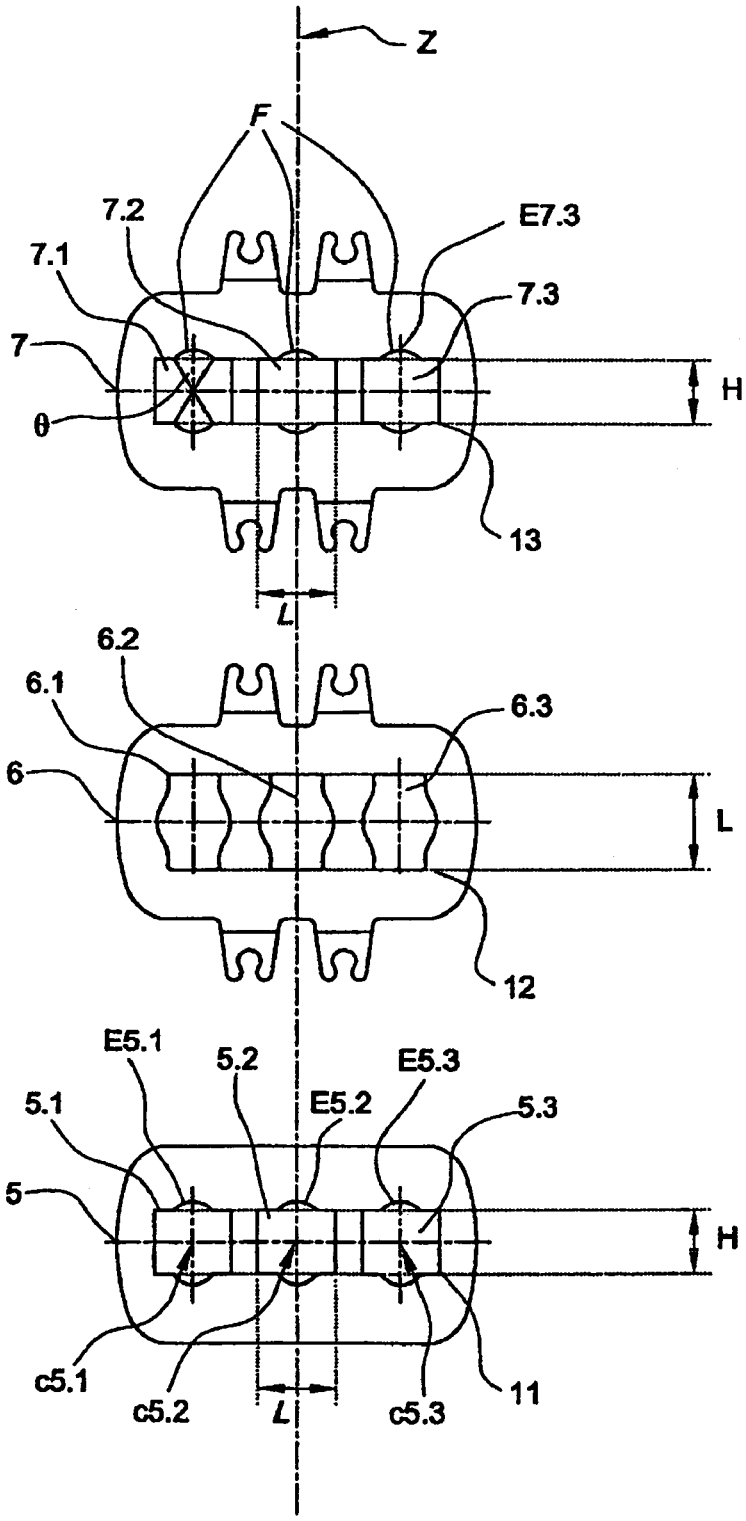

The shapes of the various electrodes 5, 6 and 7 are represented in FIGS. 1 to 3.

For an electron gun with three-colour operation and hence intended to process three electron beams, each electrode includes two lateral apertures 5.1 and 5.3 for the electrode 5, 6.1 and 6.3 for the electrode 6 and 7.1 and 7.3 for the electrode 7 as well as a central aperture 5.2, 6.2, 7.2 respectively for the electrodes 5, 6, 7. These apertures are of rectangular general shapes. Each large side of these apertures comprises a widening such as E5.3 for the aperture 5.3 of the electrode 5. These widenings are in the shape of arcs of circles or of holes for the passage of a mounting rod for the positioning of the electrodes of the gun.

The apertures of the electrodes are of similar shapes. The smallest dimension of these apertures has the value H and the largest dimension has the value L (FIG. 3).

The electrodes 5 and 7 have their apertures oriented in such a way that their large dimensions are horizontal (in FIG. 3) whereas the electrode 6 has its apertures oriented with its large dimensions vertical that is to say perpendicular to the apertures of the electrodes 5 and 7. The surfaces of the widenings in the shape of arcs of circles preferably have the same dimensions for the various apertures of the three electrodes.

According to the invention, the electrodes 5, 6, 7 are of plane shapes.

Each rectangular aperture 5.1 to 5.3, 6.1 to 6.3 and 7.1 to 7.3 possesses a centre c5.1 to c5.3, c6.1 to c6.3 and c7.1 to c7.3 respectively which is the centre of the corresponding rectangle. The electrodes of the quadrupolar device are arranged along an axis Z which determines the mean normal direction of the electron beams in the electron gun. The centres c5.2, c6.2, c7.2 of the central apertures 5.2, 6.2, 7.2 of the three electrodes are aligned along this axis Z.

Figure 4:
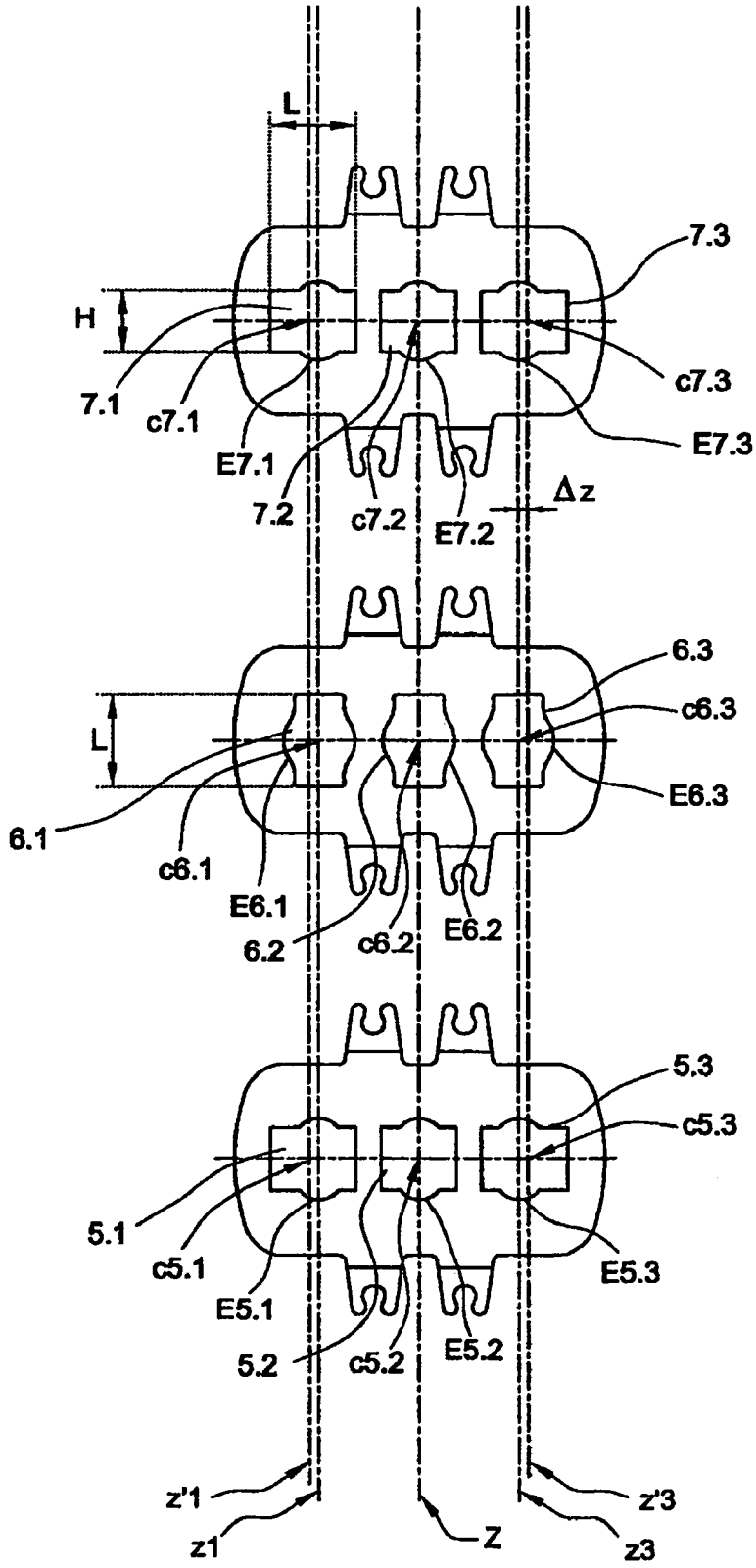
Figure 5:
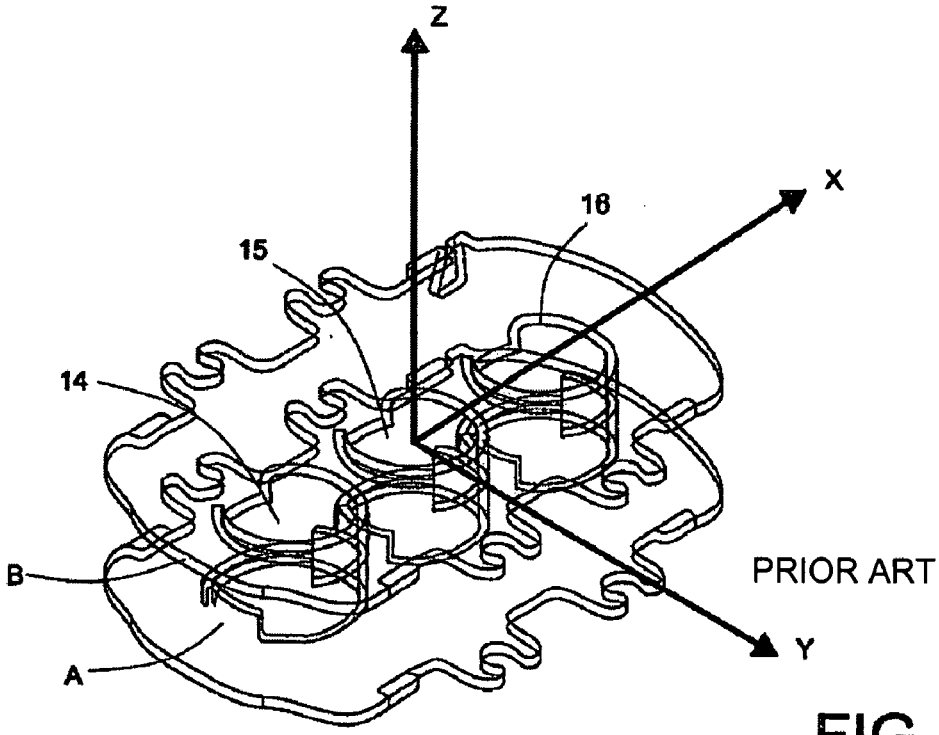
PRIOR ART FIG.5
Figure 6A:
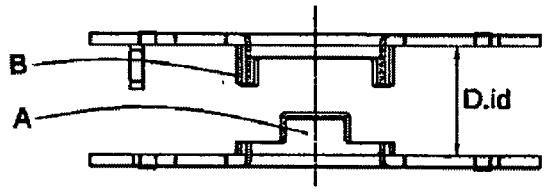
FIG.6a PRIOR ART
Figure 6B:
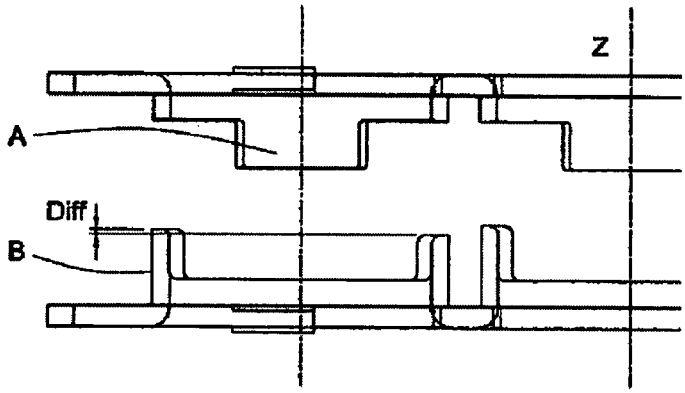
FIG.6b PRIOR ART

On the other hand, as may be seen in FIG. 4, the left lateral apertures of the electrodes 5 and 7 are offset with respect to the left lateral aperture of the electrode 6. The same holds for the right lateral apertures. It is therefore seen in FIG. 4 that if the centre c6.1 of the left lateral aperture 6.1 of the electrode 6 is on an axis z1 parallel to the axis Z, the centres c5.1 and c7.1 of the left lateral apertures 5.1 and 7.1 are aligned along an axis z'1 parallel to the axis Z but distinct from the axis z1. Likewise, the centres c5.3 and c7.3 of the right lateral apertures 5.3 and 7.3 are aligned along an axis z'3 parallel to the axis Z but distinct from an axis z3 parallel to the axis Z and which passes through the centre c6.3 of the aperture 6.3.

According to the exemplary embodiment of FIG. 4, the axes z1 and z'1 are symmetric respectively with the axes z3 and z'3 with respect to the axis Z. The distance between the axes z'1 and z'3 is greater than or less than the distance between the centres c6.1 and c6.3 of the lateral apertures 6.1 and 6.3.

The widenings or holes such as E5.2 of the central apertures of the three electrodes are aligned along the axis Z. In FIG. 4, the widenings or holes (E5.1, E6.1, E7.1) of the left lateral apertures (5.1, 6.1, 7.1) are aligned along the axis z1. Similarly, the widenings or holes of the right lateral apertures (5.3, 6.3, 7.3) are aligned along the axis z3. In this way, the configurations of the apertures of the electrode 6 do not undergo any modification and preserve their symmetries. Only the lateral apertures of the electrodes 5 and 7 are slightly modified with respect to the known techniques. However, the result of this modification is simply that the positions of these rectangular apertures are offset along the large sides of the rectangular apertures with respect to the position of the apertures 6.1 and 6.3 of the electrode 6.

A dynamic voltage V6 is applied to the electrode 6 in synchronism with the line scan and a fixed voltage Vf to the other two electrodes 5 and 7.

Figure 7:
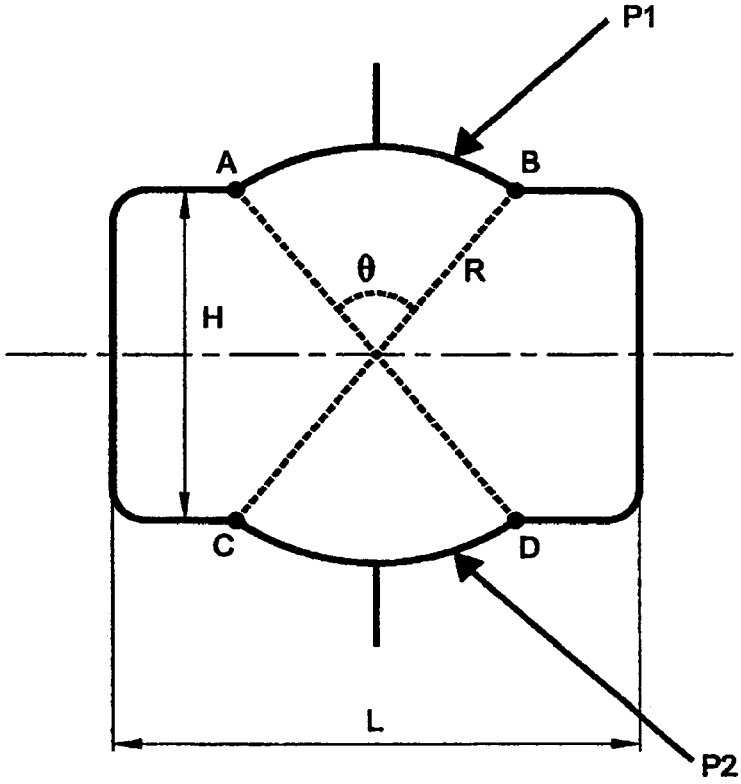

As described previously, the invention therefore consists in dealigning the lateral rectangular apertures of the electrodes 5 and 7 (FIG. 4) with respect to the lateral rectangular apertures of the electrode 6 so as to recentre the beam and hence consequently to correct the MODEC defects. This dealignment is designated Δz in FIG. 4. On the other hand, the position of the circular holes is not modified so as to be able to preserve the conventional alignment of the electrodes of the electron gun. It is also necessary that the dealignment Δz does not exceed a maximum value Δmaxi of value:

$$\Delta \max i = \frac{(L-2R)}{2}$$

in which, as may be seen in FIG. 7 which represents an aperture of an electrode:

L is the largest length of an aperture of an electrode, and R is the radius of the widening (or mounting hole).

This quadrupolar system consisting of the assemblage of the three electrodes 5, 6 and 7 requires, as indicated previously, widenings or holes F (FIG. 3) whose dimension is related to an angle θ which corresponds to a certain percentage α of the total perimeter P of the hole F and described in the following manner in conjunction with FIG. 7. The distance P1 between the points A and B of the hole F of radius R is identical to the distance P2 between the points C and D. The perimeter of the circular part of the hole is then $p$=P1+P2=2×$p$.

Support perimeter:

$$p=\alpha\times\Pi\times R \tag{1}$$

It is known that (FIG. 7), for an arc of a circle of radius R and of angle θ (in radians), we arrive at the relation which links the dimension of the arc to the angle according to the following formula $$p=R\times\theta \tag{2}$$

(1) and (2) imply θ=α×Π

Finally, and in accordance with basic trigonometric relations:

$$\cos\left(\frac{\theta}{2}\right)=\cos\left(\frac{\alpha\times\pi}{2}\right)=\frac{H}{2\times R} \tag{3}$$

Thus for a determined height H, it is essential to introduce an aperture F (FIG. 3) of radius (FIG. 7) such that the following relation is complied with:

$$R=\left\{\frac{\left(\frac{H}{2}\right)}{\cos\left(\frac{\alpha\times\pi}{2}\right)}\right\}$$

In the foregoing description, the left and right apertures of the electrodes 5 and 7 were considered to be situated on two axes z'1 and z'3. The left and right apertures of the two electrodes 5 and 7 are thus offset in the same way with respect to the right and left apertures of the electrode 6. This is an embodiment which is industrially easy to implement. However, FIGS. 9*a* and 9*b* represent variant embodiments of the invention.

Figure 9A:
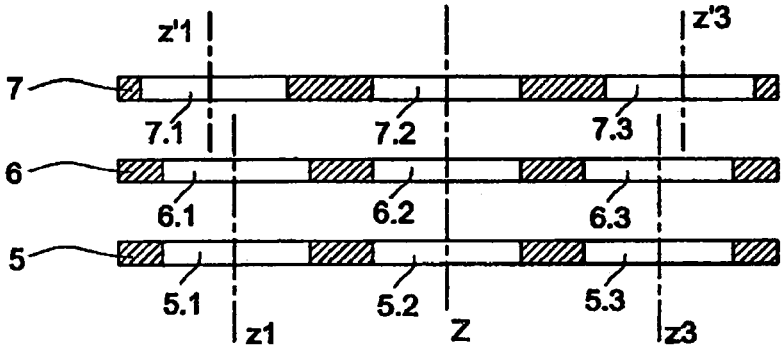

FIG. 9*a* represents in section a set of electrodes 5, 6 and 7 in which the apertures 7.1 and 7.3 of the electrode. 7 are offset with respect to the apertures 6.1 and 6.3 respectively of the electrode 6, while the apertures 5.1 and 5.3 of the electrode 5 are not offset. The left apertures 5.1 and 6.1 are therefore on one and the same axis z1 parallel to the axis Z and the apertures 5.3 and 6.3 are on an axis z3 symmetric with the axis z1 with respect to the axis Z. The apertures 7.1 and 7.3 are on the axes z'1 and z'3 symmetric to one another with respect to the axis Z and distinct from the axes z1 and z3. It is obvious that in the same way it is possible to envisage that the apertures 5.1 and 5.3, rather than the apertures 7.1 and 7.3, are the ones which are offset with respect to the apertures 6.1 and 6.3.

Figure 9B:
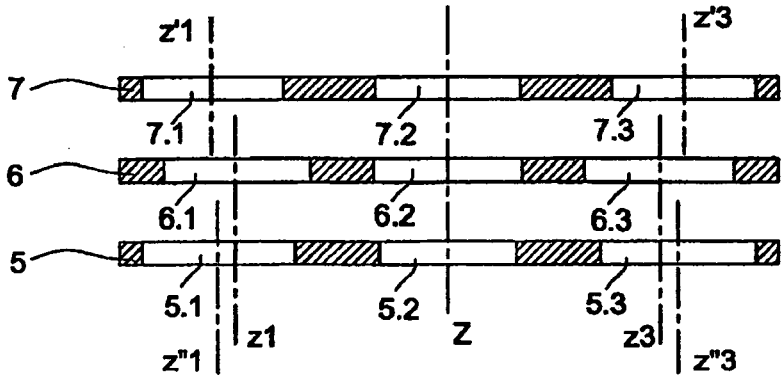

FIG. 9*b* represents in section another variant embodiment of the invention in which the left apertures are offset with respect to one another as well as the right apertures.

Thus, the apertures 6.1 and 6.3 of the electrode 6 are situated on the axes z1 and z3 symmetric to one another with respect to the axis Z.

The apertures 7.1 and 7.3 are on the axes z'1 and z'3 likewise symmetric to one another with respect to the axis Z and distinct from the axes z1 and z3 respectively.

The apertures 5.1 and 5.3 are on the axes z"1 and z"3 likewise symmetric to one another with respect to the axis Z and distinct from the various axes above.

Figure 8:
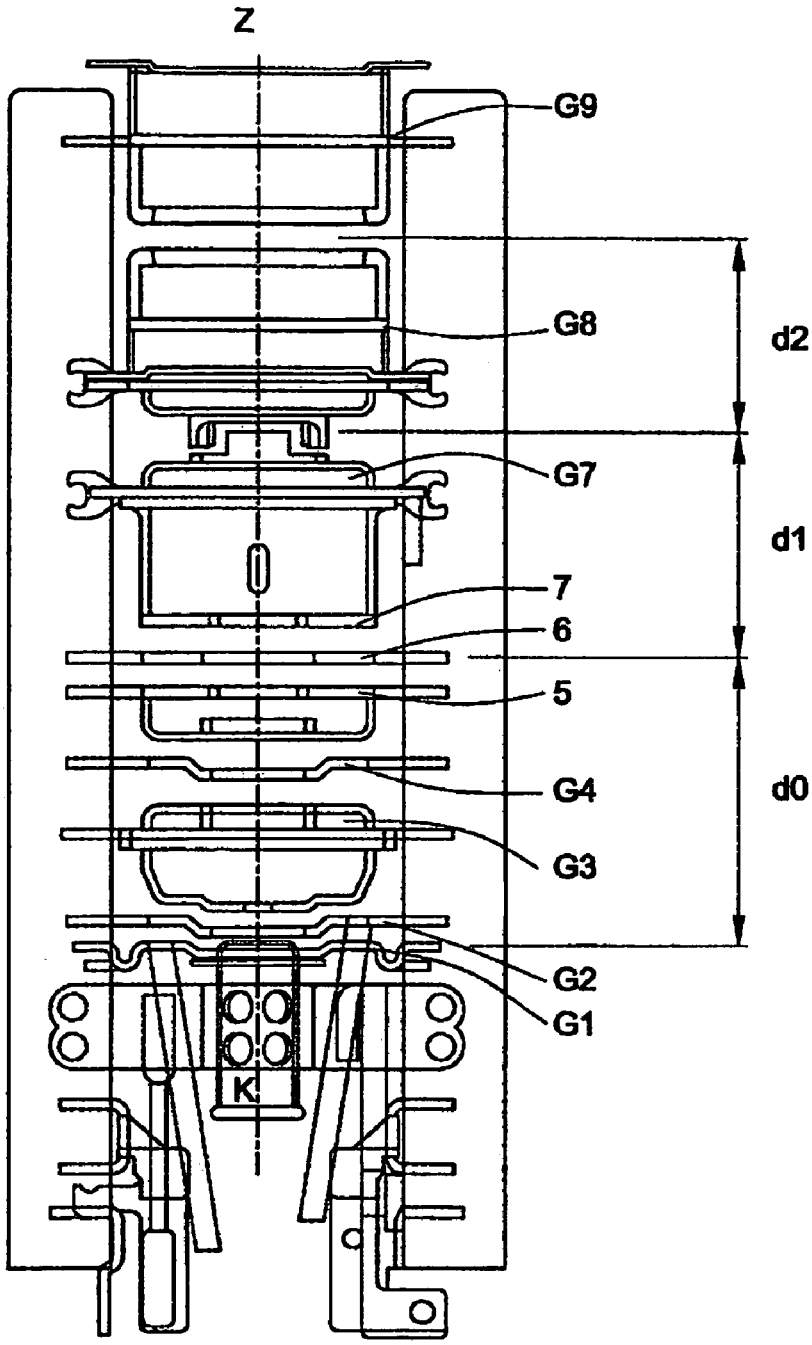

FIG. 8 represents an exemplary high-definition electron gun making it possible to implement the quadrupole device of the invention.

This electron gun comprises in succession, disposed in series along the axis Z:

- a cathode K emitting electrodes by thermo emission,
- an electrode G1 in cooperation with the electrode G2 initializes the formation of an electron beam along the axis Z on the basis of the electrons emitted by the cathode. The electrode G2 focuses the beam thus constructed towards a focusing point, called the "cross-over". The size of this focusing point is as point-like as possible. By way of example, the electrode G1 is at a static potential of between earth and 100 volts. The electrode G2 is at a potential of between 300 volts and 1200 volts,
- an electrode G3 raised, according to this example, to a potential of between 6000 and 9000 volts contributes to the acceleration of the electrons,
- an electrode G4 raised to a potential substantially equivalent to that of the electrode G2 constitutes together with the electrode G3 and a part of the electrode 5 facing G4 a prefocusing electron lens for the electron beam,
- the electrodes 5, 6 and 7 described previously while referring to FIGS. 1 to 4 and which constitute a first quadrupolar device which induces a quadrupolar effect on the beam in such a way as to exert a force of compression of the electron beam in the vertical plane and a distortion in the horizontal plane. The deformations of the beam being greater at the periphery of the screen and in particular at the corners of the screen, they increase continuously from the centre of the screen to the periphery. The set of electrodes or quadrupole 5, 6, 7 effects a precorrection as a function of the deviation of the beam. This correction must therefore be effected continuously in synchronism with the screen scan system,
- a second quadrupolar device G7-G8 which produces a quadrupolar effect which tends to exert on the electron beam a force of compression in the horizontal plane and a distortion in the vertical plane,
- an electrode G9 constituting with G8 the main exit lens of the electron gun.

According to an exemplary embodiment of the invention, the electrode 6 is situated at equal distances from the electrodes 5 and 7.

The electrodes 5 and 7 are raised to one and the same fixed potential which is for example between 6000 and 9000 volts.

The electrode 6 receives a variable potential also called a dynamic potential which varies in synchronism with the line scan. The dynamic voltage Vd varies, for example, between almost 0 volts and up to 2000 volts. The electrode 6 is at a potential V6=Vf+Vd. When the electrode beam is directed towards the centre of the screen of the cathode ray tube, the potential of the electrode G6 equals V6=V5=V7=Vf. The dynamic voltage Vd (0-2000V) is applied to the electrode 6 in a situation of deflection of the electron beams.

The voltage of the electrode 6 is therefore the sum of the Vf+Vd=V6 in the corners and at the periphery of the screen.

Moreover, as is represented in FIG. 8, the quadrupolar device constituted by the set of electrodes 5, 6, 7 is positioned at a distance d0 with respect to the cathode K and at a distance d1 with respect to the quadrupolar exit device while the latter is at a distance d2 from the main exit lens.

Preferably, the determination of the values of d0, d1 and d2 depends on the level of the dynamic voltage Vd applied to the quadrupoles and the optical transverse magnification Gt.

The variation of the transverse magnification is expressed in the form of a simple polynomial:

$$Gt=a0+a1*d1+a2*d2$$

And the dynamic voltage applied to the quadrupole 5-6-7 is expressed in the form of the polynomial:

$$Vd=bo+b1*d1+b2*d2$$

In these relations the coefficients a0 to b2 can have, by way of example, the following values:

a0=−25.74
a1=+0.51
a2=+0.27
b0=+470.21
b1=+34.04
b2=+27.17

Within the framework of an exemplary application, we may advantageously fix:

$$Vd \leqq Vd\text{max with } Vd\text{max}=1100 \text{ Volts}$$

$$Gt \geqq Gt\text{min with } Gt\text{min}=-17.5$$

The above relations may be written:

$$Vd=b0+b1*d1+b2*d2 \leqq Vd\text{max} \quad (1)$$

$$Gt=a0+a1*d1+a2*d2 \geqq Gt\text{min} \quad (2)$$

We will therefore have:

$$(Gt\text{min}-a0-a1.d1)/a2 \leqq d2 \leqq (Vd\text{max}-b0-b1.d1)/b2$$

If d1 varies from 11 mm to 14 mm:

$$11 \text{ mm} \leqq d1 \leqq 14 \text{ mm}$$

The distance d2 can be chosen in the following way for various values of d1:

| d1 in mm | d2 min in mm | d2 max in mm |
|---|---|---|
| 11 | 9.7 | 10.7 |
| 11.09 | 9.5 | 10.5 |
| 12 | 7.8 | 9.3 |
| 13 | 5.8 | 7.8 |
| 14 | 3.9 | 6.4 |

The invention claimed is:

1. A cathode ray tube having an electron gun, the electron gun being oriented along an axis of the electron gun, the electron gun comprising at least one first quadrupolar device which comprises a first electrode, a second electrode and a third electrode that are disposed in parallel and in series along the axis of the gun, the first electrode, the second electrode and the third electrode being of plane form and each electrode possessing a central aperture, a right lateral aperture and a left lateral aperture, all three being substantially rectangular, the large sides of the apertures of the first and of the third electrode being oriented along a first direction while the large sides of the apertures of the second electrode being oriented along a second direction orthogonal to the first direction; each aperture possessing a centre, the centres of the central apertures of the three electrodes being aligned along the axis of the gun, the centres of the left and right lateral apertures of the second electrode being situated along respectively a first axis and a second axis that are parallel to the axis of the gun, the centres of the left lateral apertures of the first electrode being situated on a third axis parallel to the axis of the gun, the centres of the right lateral apertures of the first electrode being situated on a fourth axis parallel to the axis of the gun, the centre of the left aperture of the third electrode is situated on a fifth axis parallel to the axis of the gun, while the centre of the right aperture of the third electrode is situated on a sixth axis parallel to the axis of the gun, wherein:

the third, fifth or both the third and fifth axes are distinct from the first axis and the fourth, sixth or both the fourth and sixth axes are distinct from the second axis, the first, third and fifth axes are symmetric respectively with the second, fourth and sixth axes with respect to the axis of the gun, the apertures possess holes or widenings allowing the alignment of the electrodes, the holes or widenings for aligning the left lateral apertures of the three electrodes being situated along the first axis, likewise, the holes or widenings for aligning the right lateral apertures of the three electrodes being situated along the second axis, and, the holes or widenings are situated on the large sides of the apertures of the electrodes and are of circular shapes whose radius R is equal to $R=(H/2)/\cos(\alpha\Pi/2)$ with H being the distance between the two large sides of an aperture and $\alpha$ being the percentage of the perimeter of the circle of radius R.

2. The cathode ray tube according to claim 1, wherein the first electrode and the third electrode are set to a fixed polarization potential, the second electrode being set to a polarization potential varying in synchronism with the screen scan.

3. The cathode ray tube according to claim 2, wherein the electron gun comprises aligned in series along the axis:

an electron-emitting cathode, a system of electrodes effecting the formation of an electron beam and its focusing to a so-called crossover point, an electron lens for prefocusing the electron beam, the first quadrupolar device, a second quadrupolar device electrically controlled in a dynamic manner in sycnhronism with the screen scan so as to correct beam focusing defects at the screen edge, a main electron lens making it possible to focus the electron beam onto a screen.

4. The cathode ray tube according to claim 3, wherein the screen is of rectangular shape and has its large sides oriented parallel to the first direction of orientation of the large sides of the apertures of the electrodes of the first and of the third electrode of the first quadrupolar device.

5. The cathode ray tube according to claim 4, wherein the first and the third electrodes of the first quadrupolar device are at one potential and the same distance d from the second electrode of the same device.

* * * * *